United States Patent [19]

Aberle et al.

[11] Patent Number: 4,519,116

[45] Date of Patent: May 28, 1985

[54] YARN TEXTURING BY MOVING CAVITY JET WITH FLUID REMOVAL

[75] Inventors: Leonard J. Aberle; Dong W. Kim; Robert Lees; Dick C. Vermeer, all of Chester; Ernest W. Wohnig, Petersburg, all of Va.; Samuel L. Yates, Columbia, S.C.

[73] Assignee: Allied Corporation, Morris Township, Morris County, N.J.

[21] Appl. No.: 475,783

[22] Filed: Mar. 16, 1983

[51] Int. Cl.[3] ..... D02G 1/12; D02G 1/16

[52] U.S. Cl. ..... 28/257

[58] Field of Search ..... 28/256, 257; 57/280

[56] References Cited

U.S. PATENT DOCUMENTS

| | | | |
|---|---|---|---|
| 3,816,887 | 6/1974 | Smith et al. | 28/256 |
| 3,999,360 | 12/1976 | Forin et al. | 57/280 |
| 4,030,169 | 6/1977 | Enneking et al. | 28/256 |
| 4,450,607 | 5/1984 | Li et al. | 28/257 |

*Primary Examiner*—Werner H. Schroeder
*Assistant Examiner*—Andrew M. Falik
*Attorney, Agent, or Firm*—Richard A. Anderson

[57] ABSTRACT

A method and apparatus for removing fluid and cooling the wad of textured yarn on the barrier screen of a moving cavity texturing jet by deflecting the hot fluid (such as steam) away from the underside of the screen with rotating turbine blades and by drawing ambient air across the screen with a vacuum line under the screen has been discovered.

4 Claims, 14 Drawing Figures

YARN TEXTURING BY MOVING CAVITY JET WITH FLUID REMOVAL

BACKGROUND OF THE INVENTION

This invention relates to an improved method to texture yarn, particularly synthetic yarn, such as apparel or carpet yarn. This invention is an improvement of the invention disclosed in U.S. Pat. Nos. 4,296,535, 4,157,604, 4,135,280, 4,133,087, 4,074,405, 4,024,611 and 4,024,610 all hereby incorporated by reference in toto. Also of interest are U.S. Pat. Nos. 4,019,228, 3,816,887, 3,643,298 and 3,438,101 also all hereby incorporated by reference in toto.

A related invention is found in Ser. No. 413,403 filed Aug. 31, 1982, hereby incorporated by reference in toto.

This invention is an improvement over previous moving cavity jet texturing devices, and enables such devices to operate at high speed. The prior art had no means to exhaust and/or deflect fluid from inside the moving barrier screen wheel.

SUMMARY OF THE INVENTION

This invention is an improvement in a moving cavity texturing apparatus for texturing yarn comprising the texturing cavity having a barrier screen rotating in position to receive and transport as a textured wad the yarn entering the yarn texturing cavity, and a yarn energy tube communicating with the texturing cavity to direct the yarn at high energy into the texturing cavity, the rotating barrier screen being mounted on a rotating wheel having covering means. The improvement comprises an exhausting means for removing fluids from inside the rotating covered wheel and from the areas at and adjacent to the rotating barrier screen to thereby cool the yarn present on the barrier screen. Exhausting means can be a vacuum line communicating with the interior of the covering means. Alternatively, the exhausting means can be a turbine mounted within the covering means so that the turbine blades deflect the steam from the texturing cavity and prevent further disturbance of the yarn wad on the barrier screen. This steam is being ejected at high speed, 1500 ft/sec (457 m/sec) at 9–10 psig. The turbine is controlled to rotate slowly so that the deflection from the turbine blades diverts the steam outside from the interior of the covered wheel. Preferably, the exhausting means is a combination of both the vacuum line and the turbine. Preferably, the vacuum line is attached to the back cover of the covered wheel. In a multicavity texturing mechanism, each cavity has a separate section of barrier screen rotating below it, and each section contains turbine blades to deflect steam ejecting from the texturing cavity. The process of this invention is exhausting fluid from within a covered rotating wheel in a moving cavity texturing apparatus for texturing yarn. The apparatus used comprises a texturing cavity having a barrier screen rotating in a position to receive and transport as a textured wad the yarn entering the yarn texturing cavity and a yarn energy tube communicating with the texturing cavity to direct the yarn at high energy into the texturing cavity, the rotating barrier screen being mounted on a rotating wheel, and the rotating wheel being covered, whereby the fluid being exhausted from inside the covered wheel and from areas at and adjacent to the rotating barrier screen cools and prevents further disturbance the yarn wad present on the barrier screen.

DETAILED DESCRIPTION OF THE PREFERRED EMBODIMENT

Figure 1:
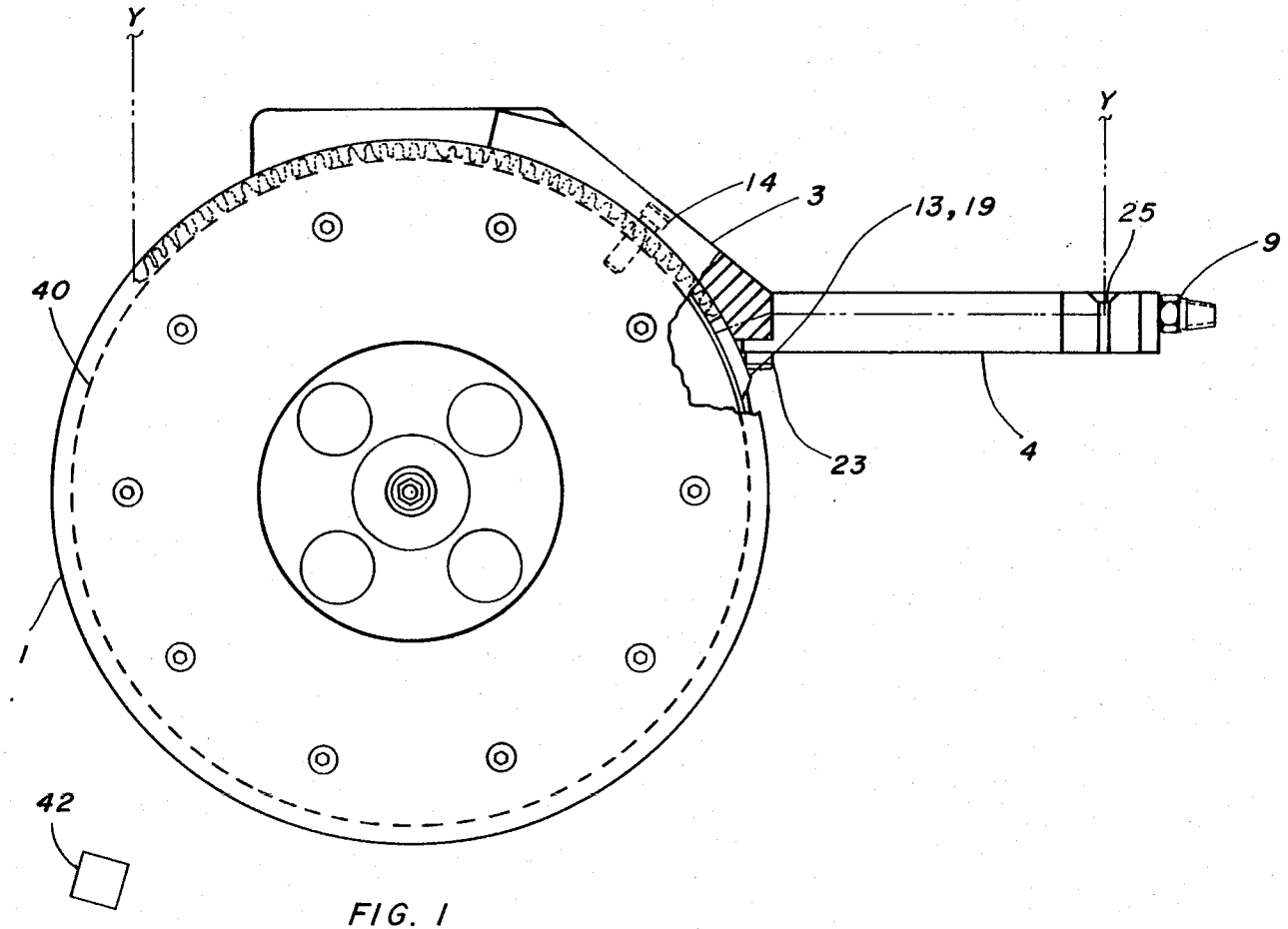
FIG. 1 is a side view of the apparatus of this invention.
Figure 2:
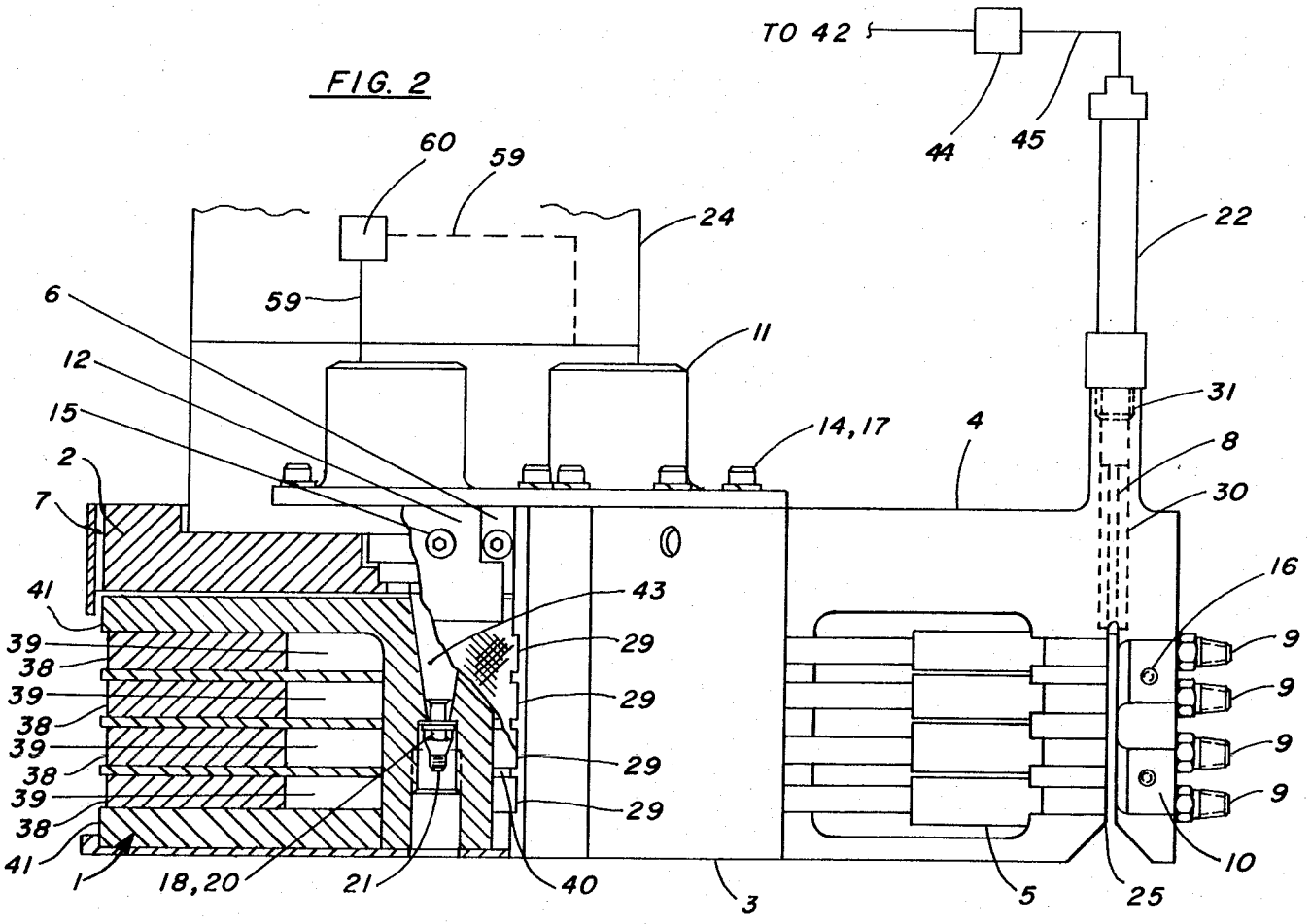
FIG. 2 is a top view with a cutaway of the apparatus of this invention.

In FIG. 1 the barrier screen 40 rotates on screen subassembly 1 under shoe 3. Shoe 3 is connected with block 4 which holds energy tubes shown in FIG. 2. Cutaway view shows plug 13 which closes the cavity where the yarn is textured. Also shown is steam nozzle 9, holding screws 14, 19 and 23 and the yarn entry slot 25. Yarn is shown as Y entering slot 25 and exiting as a wad or plug of crumpled yarn Y under shoe 3, exiting shoe 3 and taken away downstream from shoe 3 on screen subassembly 1. Overrun sensor 42 is shown schematically. In FIG. 2 the top view of the same apparatus as FIG. 1 is shown showing screen subassembly 1, back plate 2 on screen subassembly 1, shoe 3, block 4 for holding energy tubes 5, shim 6 under shoe 3, spacer 7 next to back plate 2, deflector blade 8, nozzles 9, clamp 10 for clamping nozzles 9 onto block 4, outlet plate 11, threadguard 12, fastening screws or washers 14, 15, 16, 17, 18, 20 and 21. Also shown is air cylinder 22, gear motor 24, and yarn entry slot 25. Barrier screen 40 which extends across screen subassembly 1 rotates beneath shoe 3 to receive yarn from energy tubes 5 communicating with yarn entry orifices in shoe 3. Yarn is propelled from its entrance to energy tubes 5 from yarn slot 25 by steam from steam nozzles 9. In case a yarn plug or wad of crumpled textured yarn overruns its normal take-off position several inches past the exit of yarn cavities 29, air cylinder 22 is actuated by overrun sensor 42 activating solenoid valve 44 in pressure air line 45, quickly serving yarn deflector blade 8 into yarn slot 25 thereby deflecting both yarn and steam from entering energy tubes 5 and thereby cavity 29 and shoe 3. Yarn deflector blade 8 is normally stored in cavity 30. Air cylinder 22 is attached to block 4 with screw connection fittings 31. Assembly 1 is rotated by means of gear motor 24 directly connected to the shaft 43. Subassembly 1 has end disks 41, one of which is integral with shaft 46, mounted on shaft 43. Ambient air flows through the yarn plug on screen 40 by means of vacuum in screen subassembly 1, thereby cooling the yarn. Vacuum line 59 and vacuum source 60 are shown connected to outlet plate 11. Vacuum source 60 may be attached only to the outlet plate side which is in communication with the air exhaust port or alternatively, as shown by the dashed line also to the outlet plate portion communicating with the steam exhaust port. Space 39, disks 26 and spacers 38 are also shown in subassembly 1.

Figure 3:
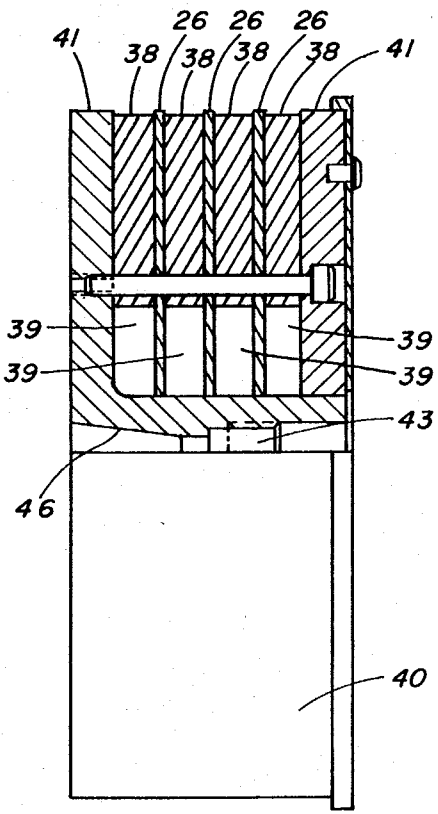
FIG. 3 is a top partially cutaway view of the barrier screen subassembly of this invention.

In FIG. 3 the screen subassembly is shown with barrier screen 40 cutaway showing space 39, spacers 38, disks 26, end disks 41, one of which is integral with shaft 46. Shaft 46 is mounted on shaft 43.

Figure 4:
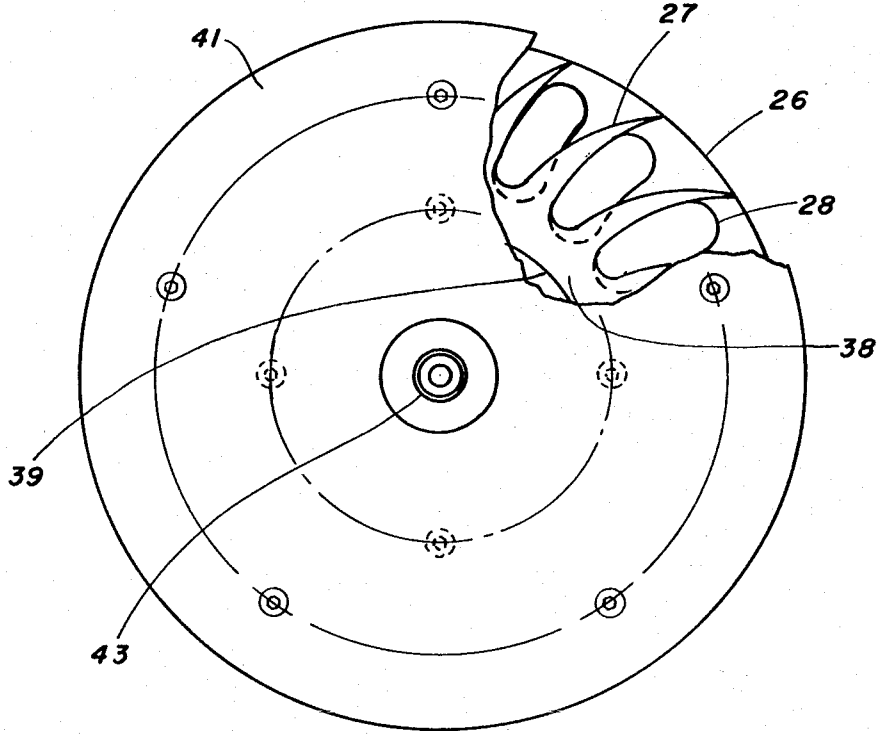
FIG. 4 is a partially cutaway side view of the barrier screen subassembly showing the turbine blades on the spacer of this invention.

In FIG. 4 the side view of the screen subassembly is shown with end disk 41 in place over spacer 38 having turbine blades 27, behind which is positioned disk 26 with exhaust port 28. Also shown in the center is shaft 43. Space 39 is shown near the center of the subassembly. Vacuum from within subassembly 1 draws fluid through exhaust ports 28, which also exhaust deflected steam by turbine blades 27.

Figure 5:
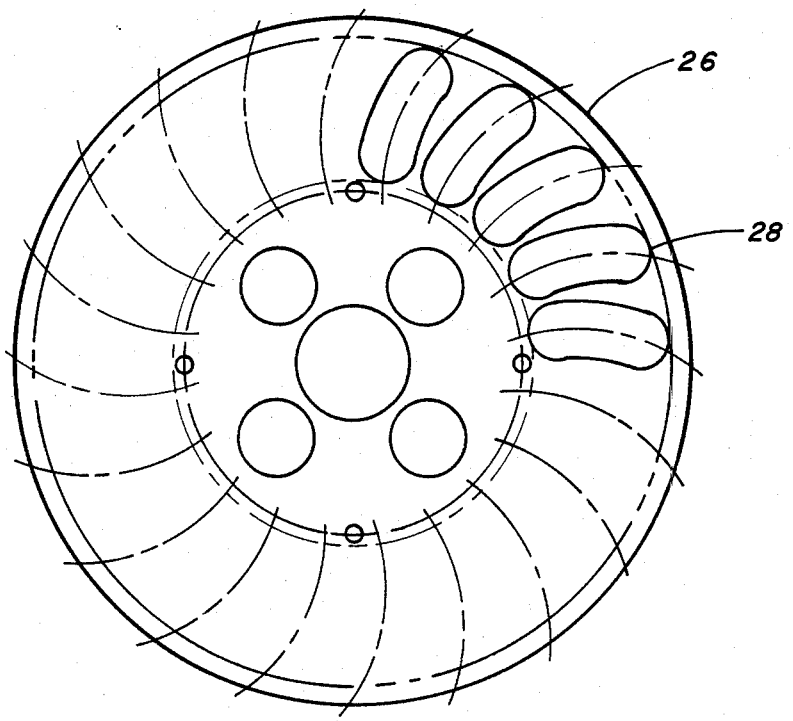
FIG. 5 is a side view of a disk within the barrier screen subassembly of this invention.

In FIG. 5 an inside disk is shown as disk 26 having exhaust port 28 to allow passage of fluids through the subassembly.

Figure 6:
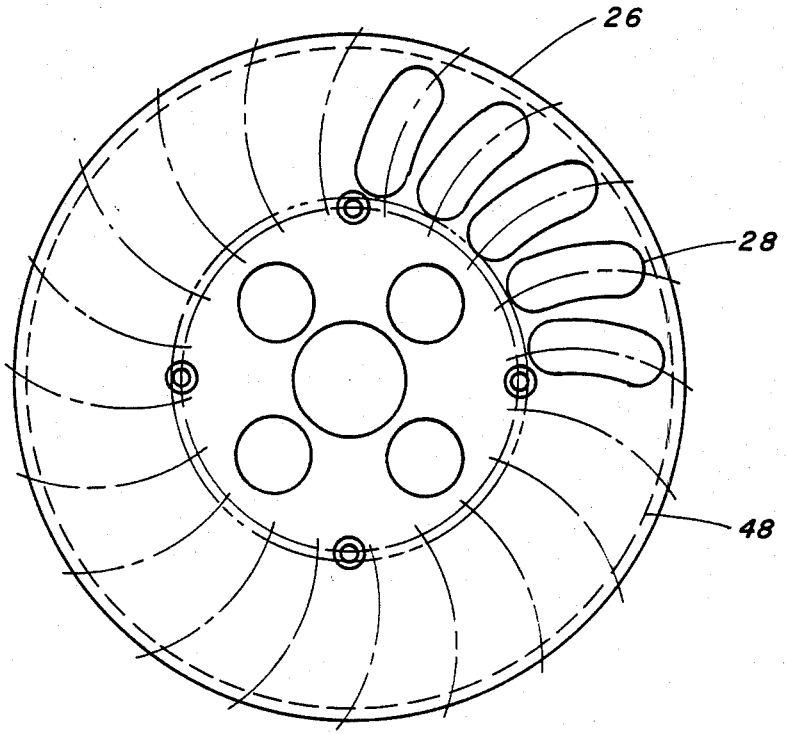
FIG. 6 is a side view of an end disk within the barrier screen subassembly.
Figure 7:
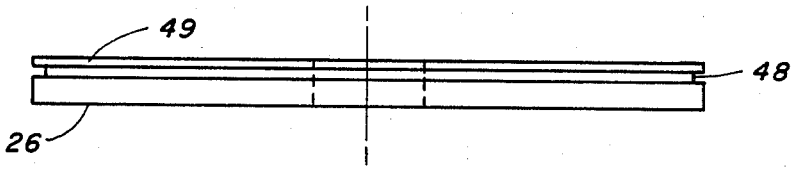
FIG. 7 is a top view of an end disk within the barrier screen subassembly.

An end disk 26 is shown in FIGS. 6 and 7 having a groove 48 and a lip 49 for mounting at the end of the subassembly. Port 28 is also shown.

Figure 8:
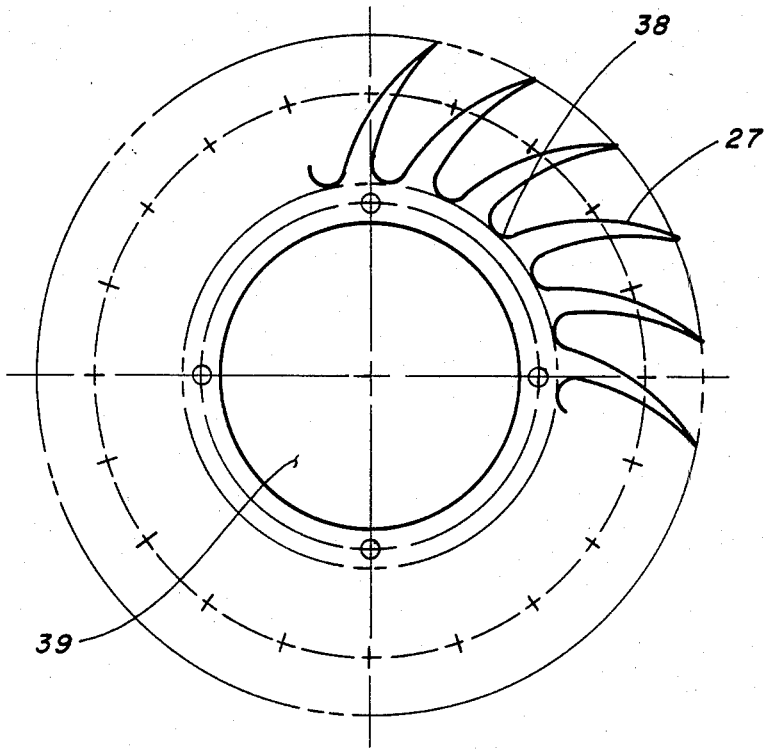
FIG. 8 is a side view of the spacer within the barrier screen subassembly, the spacer having turbine blades of this invention.
Figure 9:
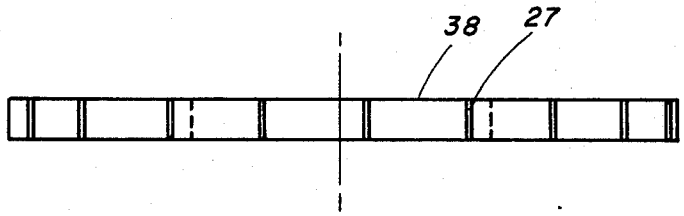
FIG. 9 is a top view of the spacer in the barrier screen subassembly.

In FIGS. 8 and 9 a spacer 38 is shown having turbine blades 27 and space 39 therein.

Figure 10:
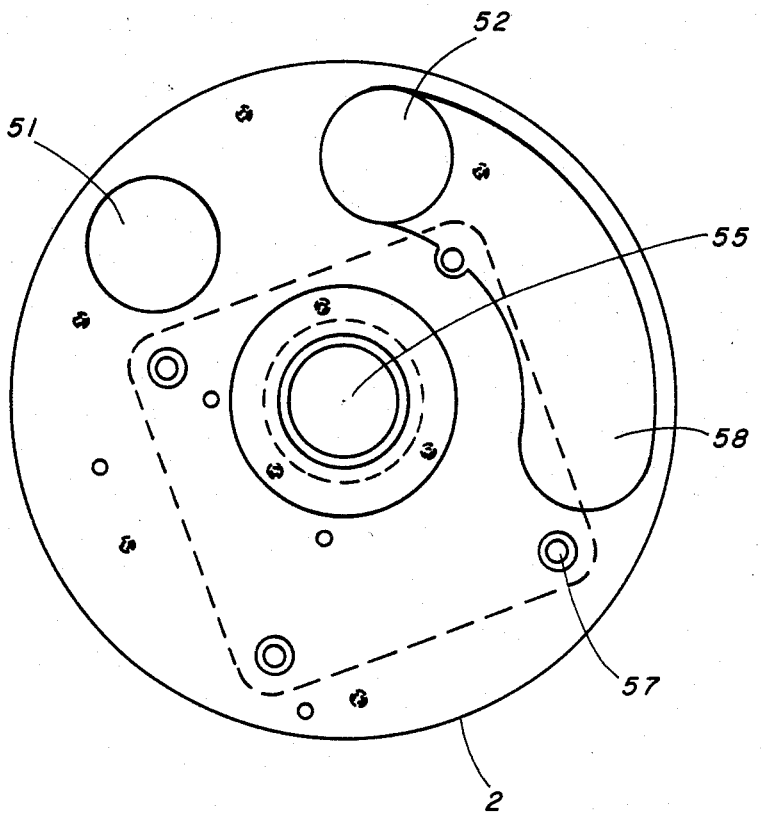
FIG. 10 is a side view of the back plate of the barrier screen subassembly of this invention.

In FIG. 10 back plate 2 is shown with steam port 51 and air exhaust port 52 shown. Air exhaust 52, communicates with air exhaust recess area 58 to facilitate flow of air by vacuum from within the screen subassembly, also shown are mounting holes 57.

Figure 11:
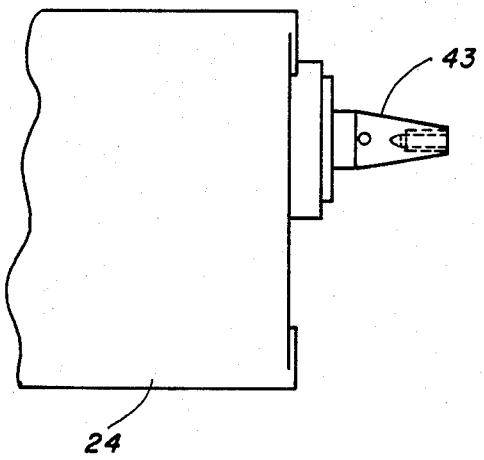
FIG. 11 is an end view of the gear motor and bearing upon which the barrier screen subassembly is mounted.
Figure 12:
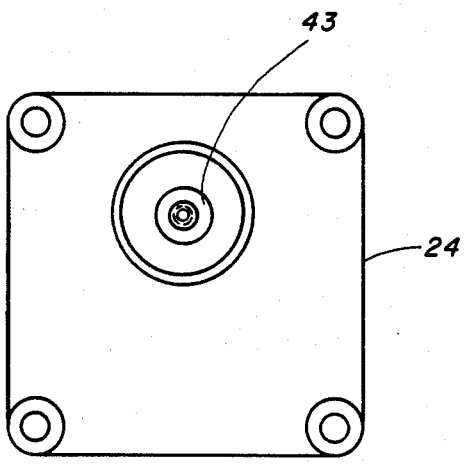
FIG. 12 is a side view of the gear motor and bearing upon which the subassembly is mounted.

In FIGS. 11 and 12 gear motor 24 and shaft 43 are shown.

Figure 13:
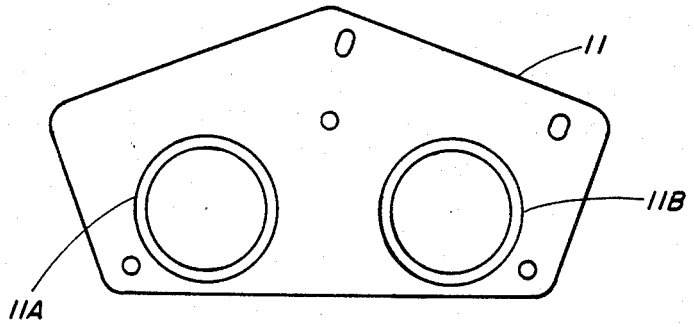
FIG. 13 is a side view of the outlet plate of the barrier screen subassembly of this invention.
Figure 14:
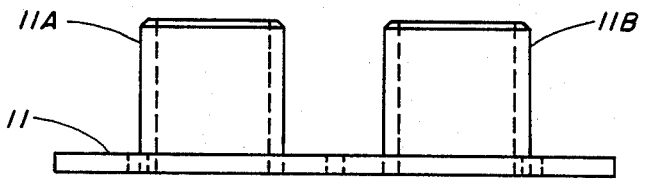
FIG. 14 is a top view of the outlet plate of the barrier screen subassembly of this invention.

In FIGS. 13 and 14 outlet plate 11 is shown having steam exhaust receiver 11A and air exhaust receiver 11B.

EXAMPLE 1

Nylon 6 chips were melt spun using a screw-type extruder in which the temperature was maintained at 270° C. to 275° C. A polymer directly spun from the melt as in U.S. Pat. No. RE. 28,937 and U.S. Pat. No. 4,310,659, both hereby incorporated by reference, could also be used. A 70-hole spinnerette with asymmetric "Y" shaped capillaries was used. As the polymer exited the spinnerette it was passed through a cross-flow quench air zone at 100 feet (31 meters) per minute, 25° C. and 65 percent relative humidity prior to drawing. A spin finish emulsion was employed to assist drawing the fiber. Drawing the fiber consisted of passing it around a nonheated draw roll and idler and then around a pair of heated draw rolls having surfaces that were maintained at 155° C. Drawing speed was 10170 feet per minute (about 3100 meters per minute).

The fiber was textured using the apparatus shown. Superheated steam was supplied into and through a nozzle 1.5 inches (38 mm) long which had an inside diameter of 0.070 inch (1.8 mm). The superheated steam at 260° C. and 90 psig (6.1 atmospheres) transported the fiber through an energy tube which was 4.371 inches (111 mm) long and had an inside diameter of 0.130 inch (3.3 mm). As the fiber exited the energy tube it impinged on a rotating barrier screen at an angle of 60 degrees and was contained by the stationary, integral, multicavity shoe. The barrier was a 9-inch (230 mm) diameter stainless steel mesh screen that rotated at 40 rpm and a surface speed of 94.2 feet (28.7 m) per minute. The barrier was 0.0126, inch (0.32 mm) thick, had a hole size of 0.034 inch (0.86 mm) and an open area of 46.2 percent. Each cavity of the integral shoe was 0.200 inch (5.0 mm) deep by 0.500 inch (12.7 mm) wide and 47 degrees long. Impinging the yarn on the barrier initiated crimping the fiber and retardation of the yarn flow caused by the yarn to compact and form a plug or wad of yarn where further crimping took place. At this time the barrier became the transport mechanism for the yarn plug. Cooling of the yarn plug on the barrier screen is enhanced by vacuum from inside the moving screen transport. The vacuum was at 16.5 inches (420 mm) of water and caused a flow of about 2000 ft/min (610 m/min) at the outside exhaust port. The turbine blades on the spacers in the rotating screen subassembly exhaust steam which is exiting from the front of the texturing cavities by deflecting the steam through the steam exhaust port to outside the covered rotating screen subassembly (covered wheel). Rotating at 40 rpm and surface speed of 94.2 feet (28.7 m) per minute, the turbine blades act, not in a true turbine effect, but only as deflectors of the steam at very high velocity, about 1500 feet (457 m) per second. A stationary deflector blade would also function in the same way and this invention includes such an apparatus and method. The yarn plug exited the integral cavity shoe through an opening and was taken up on conventional winders at approximately 7900 feet (2400 m) per minute. An optical plug control sensor can control the location of the yarn plug end, where it unfolds for takeup. Also, an optical overrun sensor is used to shut down the apparatus when the yarn plug overruns its normal position.

The textured yarn produced had a bulk level of 18 C.E.A.B., a total boil shrinkage of 12 percent and a nominal denier of 1100. The textured yarn was tufted into carpet and dyed as a standard cut-pile fabric. The fabric was streak-free and had a soft and lustrous appearance.

The C.E.A.B. means crimp elongation after boiling and is fully described in U.S. Pat. No. 4,356,280, Oct. 26, 1982, hereby incorporated by reference.

Before invention of the turbine to deflect steam from the energy there was no way to separate steam from air; any attempt to pull air from the area also brought steam, requiring a high capacity system. The turbine blades prevent steam flow through the area under the screen. Previously, this steam flow disturbed the yarn plug on the barrier screen causing adjacent ends of yarn to entangle when multiple ends were textured, making operation of the moving cavity jet impossible. The turbine blades provide a barrier so that the steam exhaust and air exhaust are each confined to a particular segment of barrier screen. Thus, cooling of the wad on the cooling setment is much more effective. Also, previously steam would bounce off the center shaft of the rotating wheel causing disruption of the yarn wad at the barrier screen.

Operation of the moving cavity jet without use of vacuum to cool the yarn wad or plug gave the following disadvantages.

1. Yarn filaments melt on the screen, causing sticking of the yarn plug and breakouts during operation.

2. Lower undesirable values for crimp elongation after boil causing poor bulk in the carpet yarn produced as tufted in carpet.

3. Much poorer yarn mechanical quality, e.g., more loops and broken filaments.

4. Additional steam energy required for adequate yarn properties such as crimp.

5. When processing multiple ends of yarn so that, for example, four ends of yarn wads are present on the rotating barrier screen, the four ends oscillate on the feed rolls prior to the moving cavity energy tubes causing break-outs to shut down the unit, and insufficient thermal stability in the yarn (lack of crimp retention) and the previously mentioned poor mechanical quality.

The combination of turbine blade deflection and vacuum cooling has made possible high speed texturing (over 10,000 ft/min (3100 m/min)) operation and high quality yarn such as highly acceptable commercial nylon carpet yarn, not possible prior to this invention.

We claim:

1. In a moving cavity texturing apparatus for texturing yarn comprising a texturing cavity having a barrier screen rotating in position to receive and transport as a textured wad said yarn entering said yarn texturing cavity and a yarn energy tube communicating with said texturing cavity to direct said yarn at high energy into said texturing cavity, said rotating barrier screen being mounted on a rotating wheel having a covering means for said rotating wheel, the improvement comprising exhausting means for removing fluid from inside said covered rotating wheel and from areas at and adjacent to said rotating barrier screen thereby cooling any yarn present on said barrier screen, wherein the exhausting means is a turbine mounted within said covering means, said turbine controlled to rotate slowly so that steam is deflected by turbine blades to outside the covering means for the rotating wheel, thereby preventing further disturbance of the wad of yarn on the barrier screen.

2. The apparatus of claim 1 wherein the exhausting means is said combination of both a turbine mounted within said covering means and a vacuum line communicating with the interior of said covering means.

3. The process of exhausting fluid from within a covered rotating wheel in a moving cavity texturing apparatus for texturing yarn, said apparatus comprising a texturing cavity having a barrier screen rotating in a position to receive and transport as a textured wad the yarn entering the yarn texturing cavity, a yarn energy tube communicating with the texturing cavity to direct the yarn at high energy into the texturing cavity, said rotating barrier screen being mounted on a rotating wheel having a covering means, comprising exhausting the fluid from inside the covered wheel and from areas at and adjacent to the rotating barrier screen to thereby cool and stabilize the yarn wad being transported on the barrier screen, wherein fluid is exhausted as it leaves the texturing cavity by deflection by turbine blades to outside the covering means of the rotating wheel.

4. The process of claim 3 wherein fluids within the covered wheel are exhausted by vacuum in combination with said turbine blades which rotate slowly to deflect steam exiting from the texturing chamber, each turbine blade deflecting steam to outside the covering means of the rotating wheel.

* * * * *